US009062432B2

(12) United States Patent
Takagi et al.

(10) Patent No.: US 9,062,432 B2
(45) Date of Patent: Jun. 23, 2015

(54) DEPRESSION-PROVIDED STEEL PIPE AND COMPOSITE PILE

(75) Inventors: Masahide Takagi, Tokyo (JP); Shinji Taenaka, Tokyo (JP); Tetsu Satoh, Tokyo (JP); Yuki Motegi, Tokyo (JP); Takashi Oosawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/981,415

(22) PCT Filed: Feb. 22, 2012

(86) PCT No.: PCT/JP2012/054246

§ 371 (c)(1),
(2), (4) Date: Jul. 24, 2013

(87) PCT Pub. No.: WO2012/115138

PCT Pub. Date: Aug. 30, 2012

(65) Prior Publication Data

US 2013/0309023 A1 Nov. 21, 2013

(30) Foreign Application Priority Data

Feb. 22, 2011 (JP) ..... 2011-035535

(51) Int. Cl.
*E02D 5/28* (2006.01)
*B21C 37/15* (2006.01)
(Continued)

(52) U.S. Cl.
CPC ..... *E02D 5/285* (2013.01); *B21C 37/158* (2013.01); *B21D 15/00* (2013.01); *B21D 17/02* (2013.01)

(58) Field of Classification Search
CPC ..... B21C 37/158; B21D 15/00; B21D 17/02; E02D 5/285
USPC ..... 405/228, 231, 232, 244, 259.1
See application file for complete search history.

(56) References Cited

U.S. PATENT DOCUMENTS

D199,084 S * 9/1964 Feigenbaum ..... D15/199
3,623,330 A * 11/1971 Nakade et al. ..... 405/264
(Continued)

FOREIGN PATENT DOCUMENTS

CN 1730839 2/2006
CN 101899829 12/2010
(Continued)

OTHER PUBLICATIONS

Office Action dated Jan. 2, 2015 issued in corresponding Korean Application No. 10-2013-7021476.
(Continued)

*Primary Examiner* — Benjamin Fiorello
(74) *Attorney, Agent, or Firm* — Kenyon & Kenyon LLP

(57) ABSTRACT

This depression-provided steel pipe has plural depressions on an outer peripheral surface, the depressions being formed so as to form a line along an axial direction of the steel pipe, in which each of the depressed portions has, inside thereof, a columnar groove portion extending along the axial direction of the steel pipe and depressed deeper than a bottom surface of these depressed portions; $0.95 \leq H_A/H_B \leq 1.05$ is satisfied, where $H_A$ is an average Vickers hardness in each of the depressed portions, and $H_B$ is a Vickers hardness at a portion between the depressed portions adjacent to each other in the axial direction of the steel pipe; and the outer peripheral surface is covered with a mill scale.

10 Claims, 8 Drawing Sheets

(51) Int. Cl.
*B21D 15/00* (2006.01)
*B21D 17/02* (2006.01)

(56) References Cited

U.S. PATENT DOCUMENTS

| | | | | | |
|---|---|---|---|---|---|
| 3,735,541 | A | * | 5/1973 | Vanderlinde | 52/98 |
| 3,796,057 | A | * | 3/1974 | Dougherty | 405/251 |
| 4,938,631 | A | * | 7/1990 | Maechtle et al. | 522/35 |
| D415,574 | S | * | 10/1999 | Shrira | D25/61 |
| D661,381 | S | * | 6/2012 | Motegi et al. | D23/266 |
| D669,160 | S | * | 10/2012 | Motegi et al. | D23/266 |
| D669,970 | S | * | 10/2012 | Motegi et al. | D23/266 |
| D679,785 | S | * | 4/2013 | Motegi et al. | D23/266 |
| 2011/0038675 | A1 | * | 2/2011 | Nakaji et al. | 405/231 |

FOREIGN PATENT DOCUMENTS

| | | |
|---|---|---|
| JP | 61-162657 | 7/1986 |
| JP | 07-127053 | 5/1995 |
| JP | 2003-245714 | 9/2003 |
| JP | 2005-351383 | 12/2005 |
| JP | 2008-175055 | 7/2008 |
| KR | 20-0263963 | 2/2002 |

OTHER PUBLICATIONS

International Search Report dated Apr. 17, 2012, issued in corresponding PCT Application No. PCT/JP2012/054246.
Office Action dated Apr. 10, 2015 issued in corresponding Taiwanese Application No. 101105808.

* cited by examiner

DEPRESSION-PROVIDED STEEL PIPE AND COMPOSITE PILE

TECHNICAL FIELD

The present invention relates to a depression-provided steel pipe and a composite pile used for forming a civil engineering and construction structure.

This application is a national stage application of International Application No. PCT/JP2012/054246, filed Feb. 22, 2012, which claims priority to Japanese Patent Application No. 2011-035535 filed in Japan on Feb. 22, 2011, the disclosures of which are incorporated herein by reference in their entirety.

BACKGROUND ART

Piles used as foundation for civil engineering and construction structures achieve a supporting force derived from an end supporting force and a frictional force on the outer peripheral surface. The end supporting force is a bearing pressure resistance occurring at an end portion of the pile, which is driven into hard ground to obtain a large supporting force. The frictional force on the outer peripheral surface occurs from a frictional force between the pile and the ground. In general, the frictional force on the outer peripheral surface occurring between the steel pipe pile and the ground is small.

Thus, the large supporting force is obtained by driving the supporting piles until they reach the hard supporting layer, or using long or large-diameter piles to increase the frictional area on the outer peripheral surface. Thus, in the case where the ground is weak or the supporting layer is located deeply in the ground, the size of the pile needs to be increased, resulting in uneconomical design.

In order to address these problems, for example, Patent Document 1 discloses a configuration capable of reaching the piles up to the hard supporting layer, and a recess-provided steel pipe and a composite pile in which the steel pipe needs not to be longer or larger in diameter than necessary. This recess-provided steel pipe and the composite pile have groove portions provided thereto to increase the adhesive force with the ground or solidified material such as concrete, cement, and soil cement in an integrated manner, thereby achieving increased supporting force.

Further, for example, Patent Document 2 discloses a technique of inserting a steel pipe having groove portions formed thereto into a hole formed in the bedrock to fix the bedrock, and inflating the steel pipe.

RELATED ART DOCUMENTS

Patent Documents

Patent Document 1: Japanese Unexamined Patent Application, First Publication No. 2008-175055

Patent Document 2: Japanese Unexamined Patent Application, First Publication No. 2003-245714

DISCLOSURE OF THE INVENTION

Problems to be Solved by the Invention

In the steel pipe and the composite pile described in Patent Document 1, the groove portion provides sufficient adhesive force with the solidified material.

However, the formation of the groove portion on the outer peripheral surface of the steel pipe possibly leads to a reduction in the compressive strength of the steel pipe itself. In other words, the strength of the composite pile is evaluated on the basis of the total of the strength of the steel pipe and the strength of the ground-improved portion such as the solidified material. Thus, due to the reduction in the compressive strength of the steel pipe itself, there is a concern of insufficient supporting force of the composite pile.

Further, the technique described in Patent Document 2 above is a technique of inflating the steel pipe inserted into the bedrock to adhere the bedrock to the steel pipe, and is intended to increase the frictional force between the steel pipe and the ground, solidified material and the like.

However, the final shape of the steel pipe cannot be controlled, and although the pulling-up load increases, the increase in the compressive load, which is important for the pile, is not guaranteed.

In view of the circumstances described above, an object of the present invention is to provide a depression-provided steel pipe that exhibits excellent adhesive force and compressive strength by increasing the adhesive force, for example, with the solidified material while suppressing the reduction in the strength of the steel pipe itself, and provide a composite pile using the depression-provided steel pipe, thereby obtaining sufficient supporting force.

Means for Solving the Problems

The present invention, which is derived to achieve the above object, has the following aspects.

(1) A first aspect of the present invention provides a depression-provided steel pipe having plural depressions on an outer peripheral surface, the depressions being formed so as to form a line along an axial direction of the steel pipe, in which each of the depressed portions has, inside thereof, a columnar groove portion extending along the axial direction of the steel pipe and depressed deeper than a bottom surface of these depressed portions; $0.95 \leq H_A/H_B \leq 1.05$ is satisfied, where $H_A$ is an average Vickers hardness in each of the depressed portions, and $H_B$ is a Vickers hardness at a portion between the depressed portions adjacent to each other in the axial direction of the steel pipe; and the outer peripheral surface is covered with a mill scale.

(2) In the depression-provided steel pipe according to (1) described above, at any position along an axis of the steel pipe, a percentage of a total circumferential length at each of the depressed portions of the steel pipe relative to an entire perimeter of the depression-provided steel pipe may be 50% or less.

(3) In the depression-provided steel pipe according to (1) or (2) described above, the depressed portions may be arranged so as to form four or more lines in parallel.

(4) In the depression-provided steel pipe according to (3) described above, among the lines of the depressed portions, lines of the depressed portions adjacent in the circumferential direction may be formed so as to have a phase difference in the axial direction of the steel pipe; and the phase difference may be not less than ⅛ and not more than ½ of a distance between centers of the depressed portions adjacent in the axial direction of the steel pipe.

(5) In the depression-provided steel pipe according to (1) or (2) described above, the depressed portions may be arranged so as to form six or more lines in parallel.

(6) In the depression-provided steel pipe according to (5) described above, among the lines of the depressed portions, lines of the depressed portions adjacent in the circumferential direction may be formed so as to have a phase difference in the axial direction of the steel pipe; and the phase difference may be not less than ⅛ and not more than ½ of a distance between centers of the depressed portions adjacent in the axial direction of the steel pipe.

(7) In the depression-provided steel pipe according to any one of (1) to (6) described above, each of the depressed portions may have an oval shape with a major axis in parallel to the axial direction of the steel pipe.

(8) In the depression-provided steel pipe according to any one of (1) to (7) described above, each of the depressed portions may be formed through hot roll forming using a steel pipe processing roll having a surface with a raised portion.

(9) In the depression-provided steel pipe according to any one of (1) to (8) described above, at least one of a plating layer and a resin layer may be formed on a mill scale.

(10) A second aspect of the present invention provides a composite pile formed by integrally driving the depression-provided steel pipe according to any one of (1) to (9) above into a solidified material.

Effects of the Invention

According to the invention described in (1) above, plural depressed portions are arranged on the outer peripheral surface of the steel pipe so as to form a line along the axial direction of the steel pipe, thereby increasing an area where the solidified material adheres to the outer peripheral surface of the steel pipe. Thus, it is possible to increase the adhesive force with the solidified material. Further, a columnar groove portion is formed in each of the depressed portions, thereby increasing the area where the solidified material adheres to the outer peripheral surface of the steel pipe, and achieving a frictional force or shearing force at the interface between the solidified material entering the columnar groove portion and the surrounding solidified material so as to make the columnar groove portion function as an anti-slipper, which makes it possible to further improve the adhesive force. Thus, it is possible to improve the adhesive force with the solidified material while maintaining increased compressive strength of the steel pipe itself. Yet further, in the case where there exists a portion of the depression-provided steel pipe where hardness suddenly increases, this portion exhibits deteriorated toughness or ductility, and serves as crack-starting point. This crack is more likely to advance, possibly causing deterioration in the compressive strength. However, by setting $H_A$ and $H_B$ so as to satisfy $0.95 \leq H_A/H_B \leq 1.05$, it is possible to avoid the deterioration in the compressive strength described above. In other words, by making the hardness uniform throughout the steel pipe, it is possible to achieve excellent compressive strength. Further, by adding the mill scale covering the surface of the depression-provided steel pipe having the depressed portions and the columnar groove portions provided thereto, it is possible to increase the adhesive force with the solidified material in a synergistic manner.

According to the configuration described in (2) above, at any position along the axis of the steel pipe, the percentage of the total circumferential length at the depressed portion of the steel pipe relative to the entire perimeter of the depression-provided steel pipe is set to 50% or less, whereby it is possible to avoid forming the depressed portions so as to concentrate on a specific position in the axial direction of the steel pipe. Although, in the case where a large number of depressed portions are formed in a concentrated manner in the circumferential direction of the steel pipe at the specific position in the axial direction of the steel pipe, buckling is more likely to occur at this position. However, with this configuration described in (2) above, it is possible to avoid the occurrence of such buckling. Thus, it is possible to reliably suppress the reduction in the compressive strength caused by the formation of the depressed portions, whereby it is possible to achieve excellent adhesive force and compressive strength.

According to the configuration described in (3) above, the depressed portions are arranged so as to form four lines in parallel, whereby it is possible to obtain excellent adhesive force and compressive strength uniformly in the circumferential direction of the steel pipe.

According to the configuration described in (4) above, lines of depressed portions adjacent in the circumferential direction of the steel pipe are formed so as to have a phase difference of not less than ⅛ and not more than ½, whereby it is possible to avoid the depressed portions being formed in a concentrated manner at the specific position in the axial direction of the steel pipe. Thus, it is possible to reliably obtain excellent adhesive force and compressive strength.

According to the configuration described in (5), depressed portions are arranged so as to form six or more lines in parallel, whereby it is possible to obtain excellent adhesive force and compressive strength uniformly in the circumferential direction of the steel pipe.

According to the configuration described in (6), lines of depressed portions adjacent in the circumferential direction of the steel pipe are formed so as to have a phase difference of not less than ⅛ and not more than ½, and hence it is possible to avoid the depressed portions being formed in a concentrated manner at a specific position in the axial direction of the steel pipe. Thus, it is possible to reliably obtain excellent adhesive force and compressive strength.

According to the configuration described in (7) above, each of the depressed portions has an oval shape with a major axis parallel to the axial direction of the steel pipe, whereby it is possible to increase the supporting force against the load acting in the vertical direction.

According to the configuration described in (8) above, the depressed portion is formed through the hot roll forming using a steel pipe processing roll having a surface provided with the raised portion, whereby it is possible to form the depressed portions at predetermined intervals along the axial direction of the steel pipe. Further, the mill scale (hot scaled surface) can be added uniformly on the surface of the steel pipe. Thus, it is possible to reliably obtain the effect of improving the adhesive force with the solidified material and the compressive strength.

It should be noted that these effects of the invention are not impaired even if the plating layer or resin layer is added as described in (9) above.

Further, the composite pile is formed by integrally driving the depression-provided steel pipe according to any one of (1) to (9) above into the solidified material as described in (10) above. With this configuration, it is possible to suppress the reduction in the strength of the steel pipe itself while increasing the adhesive force with the solidified material, whereby it is possible to provide a composite pile having sufficient supporting force.

EMBODIMENTS OF THE INVENTION

Figure 1A:
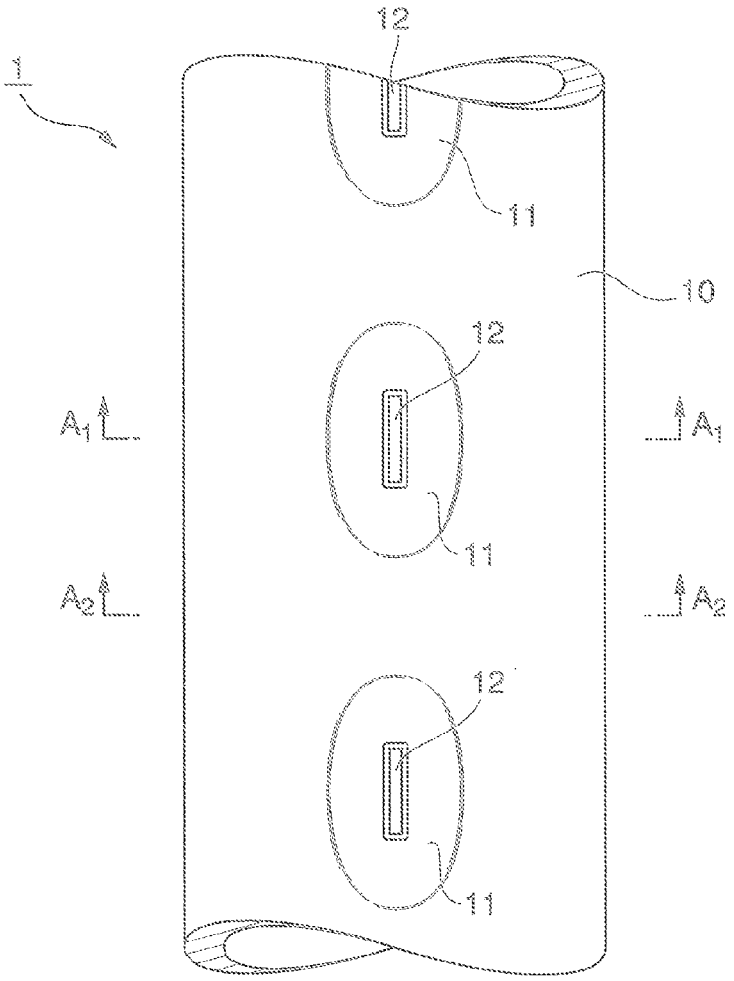
FIG. 1A is a front view partially illustrating a depression-provided steel pipe 1 according to a first embodiment of the present invention.

Hereinbelow, embodiments according to the present invention will be described with reference to the drawings.

It should be noted that, in the present specification and the drawings, the same reference characters are attached to constituting elements having substantially the same function, and explanation thereof may not be repeated.

[First Embodiment]

Below, with reference to FIG. 1A to FIG. 1D, a depression-provided steel pipe 1 according to a first embodiment of the present invention will be described.

FIG. 1A is a front view partially illustrating the depression-provided steel pipe 1 according to the first embodiment of the present invention. The depression-provided steel pipe 1 extends in the axial direction of the steel pipe so as to have a predetermined length, and for the purpose of explanation, part of the depression-provided steel pipe 1 is illustrated in FIG. 1A.

As illustrated in FIG. 1A, the depression-provided steel pipe 1 according to the first embodiment of the present invention is formed by a steel pipe body 10 having a substantially tubular shape. On the outer peripheral surface of this steel pipe body 10, plural depressed portions 11 are formed. Further, a columnar groove portion 12 is formed at the center of each of the depressed portions 11.

Figure 1B:
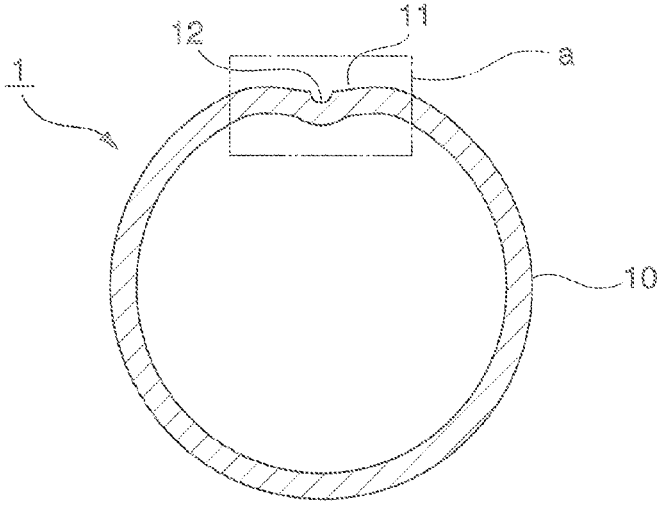
FIG. 1B is a sectional view taken along the line $A_1$-$A_1$ in FIG. 1A.
Figure 1C:
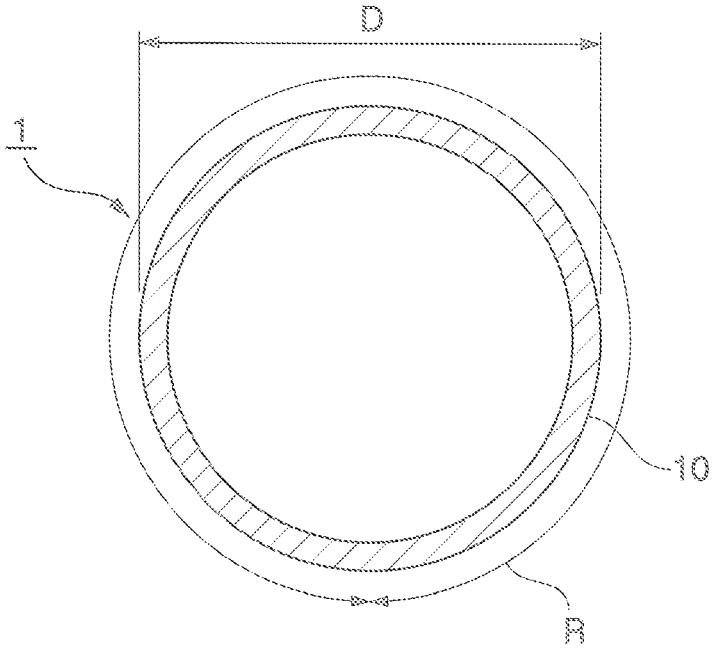
FIG. 1C is a sectional view taken along the line $A_2$-$A_2$ in FIG. 1A.

As illustrated in FIG. 1A, the plural depressed portions 11 are arranged at predetermined intervals along the axial direction of the steel pipe, thereby forming a line of depressed portions. Thus, as illustrated in FIG. 1B and FIG. 1C, the depression-provided steel pipe 1 has a cross-section located at a longitudinal position of the steel pipe where the circumferential length at the depressed. portion 11 of the steel pipe is the longest, and a cross-section located at a longitudinal position of the steel pipe where no depressed portion 11 is formed. Note that FIG. 1B is a sectional view taken along the line $A_1$-$A_1$ in FIG. 1A, and FIG. 1C is a sectional view taken along the line $A_2$-$A_2$ in FIG. 1A.

In the depression-provided steel pipe 1 according to this embodiment, only one line of the depressed portions is provided. The depressed portions 11 are formed so as to protrude in the direction toward the center of the axis of the steel pipe, in other words, protrude inwardly of the steel pipe. With the depressed portions 11 being formed, the solidified material such as concrete, cement, and soil cement enters the inside of the depressed portions 11, which leads to an increase in the adhesive force.

As illustrated in FIG. 1A, the depressed portion 11 is formed into an oval shape having the major axis extending in parallel to the axial direction of the steel pipe, whereby it is possible to obtain an effect of increasing the adhesive force while reducing the circumferential length at the depressed portion 11 of the steel pipe. By setting the direction of the major axis of the oval shape so as to match the axial direction of the steel pipe, the circumferential length at the depressed portion 11 of the steel pipe can be minimized, which makes it possible to suppress the reduction in the compressive strength caused by the formation of the depressed portion 11 as much as possible. Thus, it is desirable to form the depressed portion 11 into the oval shape having the major axis extending in parallel to the axial direction of the steel pipe. The depressed portion 11 may have a circular shape or substantially rectangular shape.

Further, the circumferential length L at the depressed portion 11 of the steel pipe may be set to 50% or less, preferably 40% or less, more preferably 30% or less of the entire perimeter R of the depression-provided steel pipe 1. More specifically, it is only necessary that, in any positions in the axial direction of the steel pipe, the percentage of the circumferential length L at the depressed portion 11 of the steel pipe relative to the entire perimeter R of the depression-provided steel pipe 1 be 50% or less, preferably 40% or less, more preferably 30% or less. In this case, it is possible to suppress the reduction in the strength of the steel pipe itself caused by the formation of the depressed portion.

It should be noted that it is only necessary that the lower limit value at the position in the axial direction of the steel pipe where the "percentage of the circumferential length at the depressed portion of the steel pipe relative to the entire perimeter R of the depression-provided steel pipe" is the maximum be more than 0%. However, the lower limit value may be set to 10% or more, or 20% or more depending on required adhesive forces.

Figure 1D:
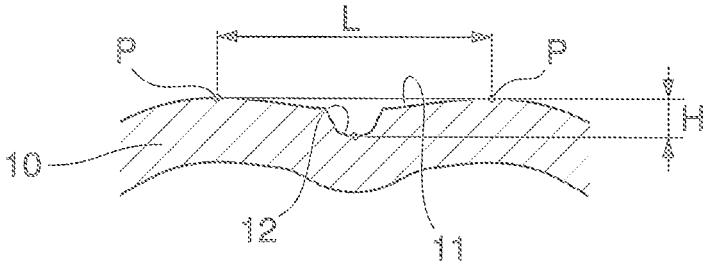
FIG. 1D is an enlarged view of a portion a in FIG. 1B.

It should be noted that FIG. 1D is an enlarged diagram illustrating a portion a in FIG. 1B. As illustrated in FIG. 1D, in this specification, the expression "circumferential length at the depressed portion of the steel pipe" represents a direct distance L between tangent points (P, P) of the common tangent line at both ends of the depressed portion in the circumferential direction of the steel pipe. Further, the "entire perimeter of the depression-provided steel pipe" represents a distance R along the outer peripheral surface of the steel pipe at a longitudinal position of the steel pipe where no depressed portion is formed (in other words, line B-B), or at a longitudinal position of the steel pipe where the formation of the depressed portion is minimum.

Below, description will be made of reasons that, at any positions in the axial direction of the steel pipe, the percentage of the circumferential length L at the depressed portion 11 of the steel pipe (in the second to the fifth embodiments, the total at a specific position in the axial direction of the steel pipe) relative to the entire perimeter R of the depression-provided steel pipe 1 is 50% or less.

The present inventors made a keen study, and found that, for example, in the case where the depression-provided steel pipe is disposed at the center of the soil cement pillar, (if a reduction in the strength is approximately 5%,) it is possible to obtain a strength similar to a soil cement pillar having a diameter approximately ten times larger than that of the steel pipe, and as compared with a soil cement pillar (improved body) without any steel pipe being provided, it is possible to reduce the size of the soil cement pillar to ⅕ resulting from an effect obtained by providing the depression-provided steel pipe to secure the similar strength. In many cases, the size of the pillar is determined according to the adhesive strength between the soil cement and the steel pipe, and even in the case where the reduction in the strength of the steel pipe is 5% or less, the entire strength of the soil cement pillar including the steel pipe hardly reduces, and this reduction only has a slight effect on the entire strength. By reducing the size of the pillar while maintaining the strength, it is possible to significantly reduce the number of working processes. Reducing the diameter of the pillar to ⅕ means a reduction in the volume of the soil cement pillar to 1/25, which leads to a significant reduction in the materials and a significant increase in the number of soil cement pillars that can be manufactured per day. On the other hand, in the case where the reduction in the strength of the steel pipe largely exceeds 5%, the size of the pillar increases, and the above-described effect reduces. From these findings, it can be determined that the allowable reduction in the percentage of the strength (in particular, compressive strength) of the steel pipe is 5% or less. Thus, by considering the condition for achieving 5% or less, which is the allowable reduction in the percentage of the strength of the steel pipe, it is desirable to satisfy $L/R \leq 0.5$. Note that, in Examples described later, the condition that the reduction in the strength of the steel pipe is 5% or less will be explained using a graph.

Further, in the depression-provided steel pipe 1 according to this embodiment, it may be possible to set, to 50% or less, the percentage of the total M2 of the longitudinal length of the depressed portion 11 of the steel pipe relative to the entire length M1 of the depression-provided steel pipe 1 in the axial direction of the steel pipe. This is because the compressive strength of the depression-provided steel pipe 1 tends to decrease in the case where the total M2 of the longitudinal length of the depressed portion 11 of the steel pipe exceeds 50% of the entire length M1 of the depression-provided steel pipe 1 in the axial direction of the steel pipe.

It should be noted that the "longitudinal length of the depressed portion of the steel pipe" represents a direct distance between tangent points of the common tangent line at both ends of the depressed portion in the axial direction of the steel pipe.

Further, at the center of each of the depressed portion 11, a columnar groove portion 12 is provided so as to be depressed further deeper than the bottom surface of the depressed portion 11 and extending along the axial direction of the steel pipe. The solidified material further enters the columnar groove portion 12. Then, there occurs a frictional force or shearing force at the interface between the solidified material entering the columnar groove portion 12 and the solidified material existing in the vicinity, and this columnar groove portion 12 functions as an anti-slipper, thereby further improving the adhesive force in addition to the adhesive force resulting from the depressed portion 11. In other words, due to restriction on relative movement of the solidified material and the steel pipe in the axial direction (catching effect), it is possible to increase the adhesive force.

The depth H of the columnar groove portion 12 is set in the range of not less than 0.005D and not more than 0.2D, where D is an outside diameter of the depression-provided steel pipe 1. In this specification, as illustrated in FIG. 1D, the depth H represents the deepest distance from the common tangent line at both ends of the depressed portion 11 in the circumferential direction of the steel pipe. By setting the depth H to 0.005D or more, it is possible to obtain a frictional force between the outer peripheral surface of the steel pipe and the ground or the solidified material. On the other hand, in the case where the depth H exceeds 0.2D, the effect of improving the frictional force saturates.

As described above, by forming the columnar groove portion at the center portion of the depressed portion 11, it is possible to achieve excellent adhesive force and excellent compressive strength. However, in the case where the depressed portion 11 and the columnar groove portion 12 are formed through cold working, the hardness of the depressed portion 11 or columnar groove portion 12 significantly increases as compared with the hardness at the midpoint between the depressed portions 11 and 11 adjacent in the axial direction of the steel pipe (portion where no depressed portion 11 or columnar groove portion 12 is formed). In this case, when the depression-provided steel pipe 1 receives a strong load, breakage is more likely to advance from a crack occurring at the portion where toughness or ductility deteriorates, possibly causing the compressive strength to deteriorate. For these reasons, in the depression-provided steel pipe 1 according to this embodiment, the depressed portion 11 and the columnar groove portion 12 are formed through hot working, thereby manufacturing the steel pipe such that the average Vickers hardness $H_A$ at the depressed portion 11 and the Vickers hardness $H_B$ at the midpoint between the depressed portions 11 and 11 adjacent to each other in the axial direction of the steel pipe satisfy $0.95 \leq H_A/H_B \leq 1.05$.

With the $H_A/H_B$ satisfying the above-described range, the entire steel pipe does not have any point in which the hardness suddenly changes, and hence, it is possible to avoid reducing the compressive strength as described above.

Further, a mill scale (a hot scaled surface) is provided covering the surface of the depression-provided steel pipe 1 according to this embodiment. Also, by forming the mill scale on the depressed portion and the columnar groove portion, it is possible to further improve the adhesive force of the depression-provided steel pipe 1 to the solidified material. It is only necessary to apply the mill scale to 95% or more of the outer peripheral surface of the depression-provided steel pipe 1 in terms of area.

Further, on the mill scale, it may be possible to form at least one of a plating layer and a resin layer.

The depression-provided steel pipe 1 according to this embodiment is manufactured, for example, by (1) with a roll unit for forming and forge welding, rounding and forming a heated steel plate into a pipe-like shape, and jointing end portions of the steel plate, thereby forming a steel pipe, and (2) then, under a condition of temperatures in the range of approximately 600° C. to 1350° C., pressing a steel pipe processing roll having a raised portion corresponding to the depressed portion 11 and the columnar groove portion 12 provided on the surface of the roll against the outer surface of the steel pipe, and adding the depressed portion 11 and the columnar groove portion 12 uniformly in the axial direction.

With these processes, it is possible to form the depressed portion 11 and the columnar groove portion 12 at uniform intervals in the axial direction of the steel pipe, obtain uniform distribution of hardness, and apply the mill scale.

[Second Embodiment]

Below, with reference to FIG. 2A and FIG. 2B, a depression-provided steel pipe 2 according to a second embodiment of the present invention will be described. The depression-provided steel pipe 2 according to this embodiment is different from the depression-provided steel pipe 1 according to the first embodiment in that four lines of the depressed portions are provided in this embodiment.

Figure 2A:
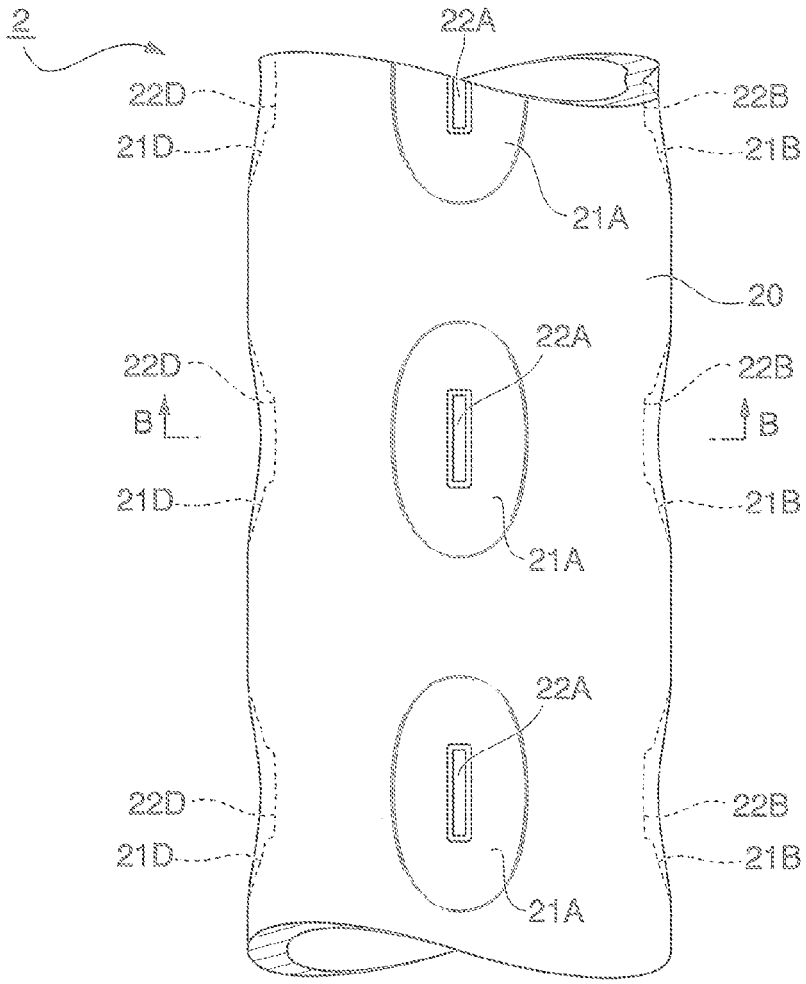
FIG. 2A is a front view partially illustrating a depression-provided steel pipe 2 according to a second embodiment of the present invention.

FIG. 2A is a front view partially illustrating the depression-provided steel pipe 2 according to the second embodiment of the present invention. The depression-provided steel pipe 2 extends in the axial direction of the steel pipe so as to have a predetermined length, and for the purpose of explanation, part of the depression-provided steel pipe 2 is illustrated in FIG. 2A.

As illustrated in FIG. 2A, the depression-provided steel pipe 2 according to the second embodiment of the present invention is formed by a steel pipe body 20 having a substantially tubular shape. On the outer peripheral surface of the steel pipe body, plural depressed portions 21 (21A to 21D) are formed. Further, at the center of each of the depressed portions 21 (21A to 21D), a columnar groove portion 22 (22A to 22D) is formed.

As illustrated in FIG. 2A, these plural depressed portions 21 (21A to 21D) are formed at predetermined intervals along the axial direction of the steel pipe, thereby forming four lines of depressed portions. Thus, as illustrated in FIG. 2B, the depression-provided steel pipe 2 has a cross-section located at a longitudinal position of the steel pipe where the total circumferential length at the depressed portion 21 of the steel pipe is longest, and a cross-section located at a longitudinal position of the steel pipe where no depressed portion is formed. Note that FIG. 2B is a sectional view taken along the line B-B in FIG. 2A.

Each of the depressed portions 21 (21A to 21D) is formed so as to protrude in the direction toward the center of the axis of the steel pipe, in other words, protrude inwardly of the steel pipe. With these depressed portions 21 (21A to 21D) being formed, the solidified material such as concrete, cement, and soil cement enters the inside of the depressed portions 21 (21A to 21D), which leads to an increase in the adhesive force.

Further, the depression-provided steel pipe 2 according to this embodiment has four lines of the depressed portions, which makes it possible to obtain excellent adhesive force and compressive strength uniformly in the circumferential direction of the steel pipe. In order to obtain this effect in a more favorable manner, it is preferable to set the lines of depressed portions uniformly in the circumferential direction of the steel pipe as illustrated in FIG. 2B. However, the lines of depressed portions are not necessarily set uniformly. It may be possible to employ a configuration in which, of the four lines of depressed portions, two adjacent lines of depressed portions are brought closer to each other depending on locations where the depression-provided steel pipe 2 is installed, and in terms of the symmetric position with respect to the axis of this steel pipe, the remaining two adjacent lines of depressed portions are brought closer to each other, for example.

As illustrated in FIG. 2A, the depressed portions 21 (21A to 21D) are formed into an oval shape having the major axis extending in parallel to the axial direction of the steel pipe, whereby it is possible to obtain an effect of increasing the adhesive force while reducing the circumferential length at the depressed portions 21 (21A to 21D) of the steel pipe. By setting the direction of the major axis of the oval shape so as to match the axial direction of the steel pipe, the total circumferential length of the depressed portions 21 (21A to 21D) can be minimized, which makes it possible to suppress the reduction in the compressive strength caused by the formation of the depressed portions 21 (21A to 21D) as much as possible. Thus, it is desirable to form the depressed portions 21 (21A to 21D) into the oval shape having the major axis extending in parallel to the axial direction of the steel pipe. The shape of the depressed portions 21 (21A to 21D) may have a circular shape or substantially rectangular shape.

Further, the circumferential length at the depressed portions 21 (21A to 21D) of the steel pipe may be set such that, at any positions in the axial direction of the steel pipe, the percentage of the total $L_{Total}$ of the circumferential lengths $L_1$ to $L_4$ at the depressed portions 21 (21A to 21D) relative to the entire perimeter R of the depression-provided steel pipe 2 is 50% or less, preferably 40% or less, more preferably 30% or less. In other words, the upper limit value of the $L_{Total}/R$ is set to 0.50 or less, preferably 40%, more preferably 30%. The reason that "0.50 or less" is preferable has already been explained in the first embodiment.

In the depression-provided steel pipe 2 according to this embodiment, the total $L_{Total}$ of the circumferential lengths $L_1$ to $L_4$ at the depressed portions 21 (21A to 21D) is maximum at the line B-B in FIG. 2A, more specifically, at the center of each of the depressed portions 21 (21A to 21D) in the axial direction of the steel pipe. Thus, in the case of the depression-provided steel pipe 2 according to this embodiment, as illustrated in FIG. 2B, it is only necessary to set the total $L_{Total}$ of the circumferential lengths $L_1$ to $L_4$ at the depressed portions 21 (21A to 21D) to 50% or less of the entire perimeter R of the depression-provided steel pipe 2. If the total $L_{Total}$ of the circumferential lengths $L_1$ to $L_4$ of the steel pipe is 50% or less of the entire perimeter R of the depression-provided steel pipe, it is possible to suppress the reduction in the strength of the steel pipe caused by the formation of the depressed portions.

Thus, it is only necessary that the percentage of the total $L_{Total}$ of the circumferential lengths $L_1$ to $L_4$ at the depressed portions of the steel pipe relative to the entire perimeter R of the depression-provided steel pipe be set to 50% or less at any positions in the axial direction of the steel pipe.

It should be noted that it is only necessary that the lower limit value at the position in the axial direction of the steel pipe where "the percentage of the total $L_{Total}$ of the circumferential lengths $L_1$ to $L_4$ at the depressed portions relative to the entire perimeter R of the depression-provided steel pipe" is the maximum be set to more than 0%. However, the lower limit value may be set to 10% or more, or 20% or more depending on required adhesive forces.

Further, in the depression-provided steel pipe 2 according to this embodiment, it may be possible to set each of the lines of the depressed portions such that the percentage of the total M2 of the longitudinal lengths at the depressed portions 21 of the steel pipe relative to the entire length M1 of the depression-provided steel pipe 2 in the axial direction of the steel pipe is set to 50% or less. This is because, in the case where the total M2 of the longitudinal lengths at the depressed portions 21 of the steel pipe exceeds 50% of the entire length M1 of the depression-provided steel pipe 2 in the axial direction of the steel pipe, the compressive strength of the depression-provided steel pipe 2 tends to decrease.

Further, at the center of each of the depressed portions 21 (21A to 21D), a columnar groove portion 22 (22A to 22D) is formed so as to be depressed deeper than the bottom surface of the depressed portion 21 and extend along the axial direction of the steel pipe. The solidified material further enters the inside of the columnar groove portion 22 (22A to 22D). Then, there occurs a frictional force or shearing force at the interface between the solidified material entering the columnar groove portion 22 (22A to 22D) and the solidified material existing in the vicinity, and this columnar groove portion 22 functions as an anti-slipper, thereby further improving the adhesive force in addition to the adhesive force resulting from the depressed portion 21. In other words, due to restriction on relative movement of the solidified material and the steel pipe in the axial direction (catching effect), it is possible to increase the adhesive force.

The depth H of the columnar groove portion 22 (22A to 22D) is set in the range of not less than 0.005D and not more than 0.2D, where D is an outside diameter of the depression-provided steel pipe 2. By setting the depth H to 0.005D or more, it is possible to obtain a frictional force between the outer peripheral surface of the steel pipe and the ground or the solidified material. On the other hand, in the case where the depth H exceeds 0.2D, the effect of improving the frictional force saturates.

As in the description in the first embodiment, in the depression-provided steel pipe 2 according to this embodiment, the average Vickers hardness $H_A$ at the depressed portion 21 and the Vickers hardness $H_B$ at the midpoint between the depressed portions 21 and 21 adjacent to each other in the axial direction of the steel pipe satisfy $0.95\ H_A/H_B \leq 1.05$. With this setting, the entire steel pipe does not have any point in which the hardness suddenly changes, and hence, it is possible to avoid reducing the compressive strength.

Further, a mill scale is provided covering the surface of the depression-provided steel pipe 2 according to this embodiment. Also, by forming the mill scale on the depressed portions and the columnar groove portion, it is possible to further improve the adhesive force of the depression-provided steel pipe 1 to the solidified material. It is only necessary to apply the mill scale to 95% or more of the outer peripheral surface of the depression-provided steel pipe 1 in terms of area.

Further, on the mill scale, it may be possible to form at least one of a plating layer and a resin layer.

The depression-provided steel pipe 2 according to this embodiment is manufactured, for example, by (1) with a roll unit for forming and forge welding, rounding and forming a heated steel plate into a pipe-like shape, and jointing end portions of the steel plate, thereby forming a steel pipe, and (2) then, under a condition of temperatures in the range of approximately 600° C. to 1350° C., pressing four rolls for forming a steel pipe having a raised portion corresponding to the depressed portion 21 and the columnar groove portion 22 provided on the surface of the roll against the outer surface of the steel pipe, and adding the depressed portions 21 and the columnar groove portions 22 uniformly in the axial direction.

With these processes, it is possible to form the depressed portions 21 (21A to 21D) and the columnar groove portions 22 (22A to 22D) at uniform intervals in the axial direction of the steel pipe, obtain uniform distribution of hardness, and apply the mill scale.

[Third Embodiment]

Below, with reference to FIG. 3A and FIG. 3B, a depression-provided steel pipe 3 according to the third embodiment of the present invention will be described. The depression-provided steel pipe 3 according to this embodiment is different from the depression-provided steel pipe 2 according to the second embodiment in that lines of the depressed portions adjacent in the circumferential direction of the steel pipe are provided so as to have a phase difference in the axial direction of the steel pipe in this embodiment. Elements that have been already explained will not be repeated.

Figure 3A:
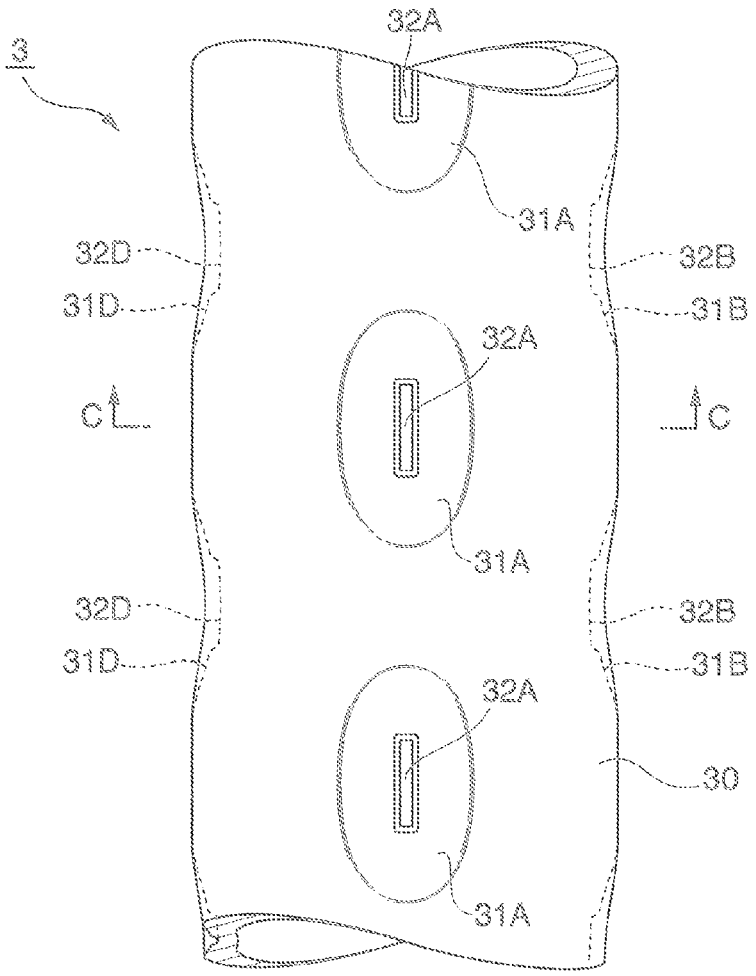
FIG. 3A is a front view partially illustrating a depression-provided steel pipe 3 according to a third embodiment of the present invention.

FIG. 3A is a front view partially illustrating the depression-provided steel pipe 3 according to the third embodiment of the present invention. The depression-provided steel pipe 3 extends in the axial direction of the steel pipe so as to have a predetermined length, and for the purpose of explanation, part of the depression-provided steel pipe 3 is illustrated in FIG. 3A.

As illustrated in FIG. 3A, the depression-provided steel pipe 3 according to the third embodiment of the present invention is formed by a steel pipe body 30 having a substantially tubular shape and including plural depressed portions 31 (31A to 31D) and a columnar groove portion 32 (32A to 32D) formed at the center of each of the depressed portions 31.

As illustrated in FIG. 3A, the plural depressed portions 31 (31A to 31D) are formed at predetermined intervals along the axial direction of the steel pipe, thereby forming four lines of depressed portions. Further, unlike the depression-provided steel pipe 2 according to the second embodiment, the depression-provided steel pipe 3 according to the third embodiment has the depressed portions 31 (31A to 31D) formed such that lines of the depressed portions adjacent in the circumferential direction of the steel pipe are arranged with a ½ phase difference. Thus, the depression-provided steel pipe 3 has a cross-section located at a longitudinal position of the steel pipe where the total circumferential length at the depressed portion 31 (31A to 31D) of the steel pipe is longest (in other words, FIG. 3B), and a cross-section located at a longitudinal position of the steel pipe where the total circumferential length at the depressed portion 31 (31A to 31D) of the steel pipe is shortest. Note that FIG. 3B is a sectional view taken along the line C-C in FIG. 3A.

In this specification, the expression "lines of the depressed portions have a phase difference" means a state in which lines of the depressed portions adjacent in the circumferential direction are positionally shifted in the axial direction of the steel pipe. Further, for example, the expression "½ phase difference" means a state in which lines of the depressed portions adjacent in the circumferential direction are positionally shifted in the axial direction of the steel pipe by a distance of ½ of a distance between centers of the depressed portions adjacent in the axial direction of the steel pipe.

Figure 3B:
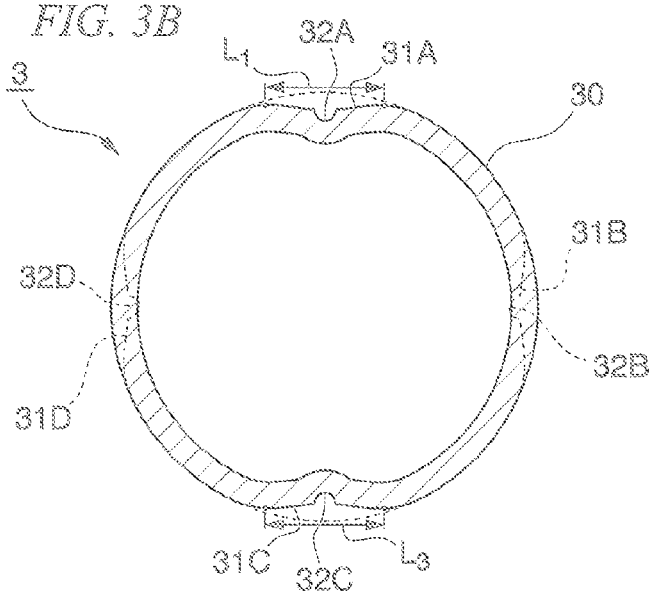
FIG. 3B is a sectional view taken along the line C-C in FIG. 3A.

As described above, in the case where the phase difference is provided, the $L_{Total}$ at the position where the $L_{Total}$ is maximum in the axial direction of the steel pipe can be suppressed only to the total of $L_1$ and $L_3$ as illustrated in FIG. 3B. Thus, it is possible to increase the depth of or the circumferential length at the depressed portions 31 (31A to 31D) of the steel pipe while suppressing the value of $L_{Total}/R$ to 50% or less. Thus, it is possible to achieve further excellent compressive strength while achieving the adhesive force with the same level as that of the depression-provided steel pipe 2 according to the second embodiment described above.

In the depression-provided steel pipe 3 according to this embodiment, although the lines of the depressed portions adjacent to each other are arranged with the ½ phase difference, it may be possible to set the phase difference to less than ½, for example to a ¼ phase difference, a ⅙ phase difference, or a ⅛ phase difference. However, even if the phase difference of less than ⅛ is applied, the effect obtained by the application of the phase difference is small. Thus, in the case where the phase difference is applied, it is preferable to apply the phase difference in the range of ⅛ to ½. Further, it may be possible to employ a configuration in which, rather than applying the phase difference to all the four lines of the depressed portions, the phase difference is applied only to one line of the depressed portions with respect to the other three lines of the depressed portions.

[Fourth Embodiment]

Below, with reference to FIG. 4A and FIG. 4B, a depression-provided steel pipe 4 according to a fourth embodiment of the present invention will be described. The depression-provided steel pipe 4 according to this embodiment is different from the depression-provided steel pipe 1 according to the first embodiment in that six lines of the depressed portions are provided in this embodiment.

Figure 4A:
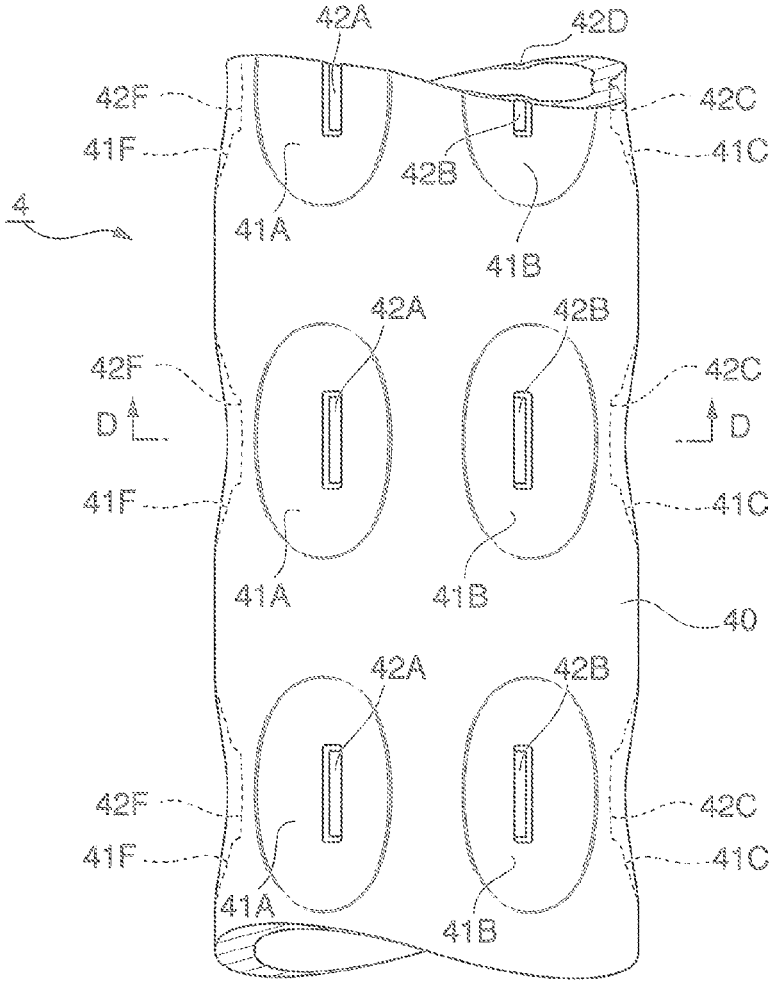
FIG. 4A is a front view partially illustrating a depression-provided steel pipe 4 according to a fourth embodiment of the present invention.
Figure 4B:
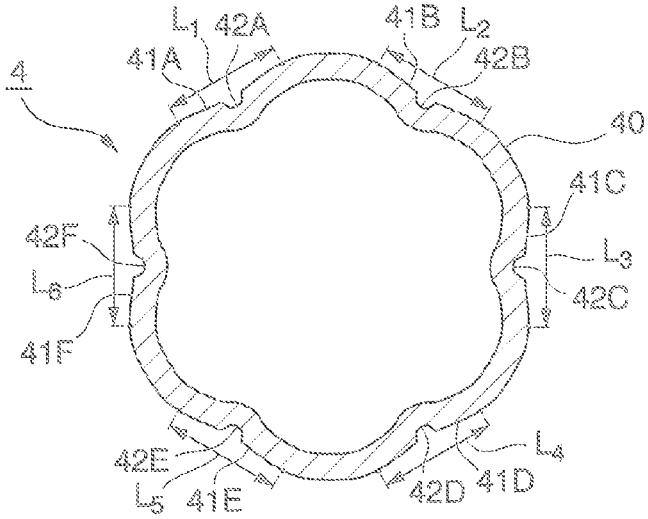
FIG. 4B is a sectional view taken along the line D-D in FIG. 4A.

FIG. 4A is a front view partially illustrating the depression-provided steel pipe 4 according to the fourth embodiment of the present invention. The depression-provided steel pipe 4 extends in the axial direction of the steel pipe so as to have a predetermined length, and for the purpose of explanation, part of the depression-provided steel pipe 4 is illustrated in FIG. 4A.

As illustrated in FIG. 4A, the depression-provided steel pipe 4 according to the fourth embodiment of the present invention is formed by a steel pipe body 20 having a substantially tubular shape. On the outer peripheral surface of the steel pipe body, plural depressed portions 41 (41A to 41F) are formed. Further, at the center of each of the depressed portions 41 (41A to 41F), a columnar groove portion 42 (42A to 42F) is formed.

As illustrated in FIG. 4A, these plural depressed portions 41 (41A to 41D) are formed at predetermined intervals along the axial direction of the steel pipe, thereby forming six lines of depressed portions. Thus, as illustrated in FIG. 4B, the depression-provided steel pipe 4 has a cross-section located at a longitudinal position of the steel pipe where the total circumferential length at the depressed portion 41 of the steel pipe is longest, and a cross-section located at a longitudinal position of the steel pipe where no depressed portion is formed. Note that FIG. 4B is a sectional view taken along the line D-D in FIG. 4A.

The depressed portions 41 (41A to 41F) are formed so as to protrude in the direction toward the center of the axis of the steel pipe, in other words, protrude inwardly of the steel pipe. With the depressed portions 41 (41A to 41F) being formed, the solidified material such as concrete, cement, and soil cement enters the inside of the depressed portions 41 (41A to 41F), which leads to an increase in the adhesive force.

Further, the depression-provided steel pipe 4 according to this embodiment has six lines of the depressed portions, which makes it possible to obtain excellent adhesive force and compressive strength uniformly in the circumferential direction of the steel pipe. In order to obtain this effect in a more favorable manner, it is preferable to set the lines of depressed portions uniformly in the circumferential direction of the steel pipe as illustrated in FIG. 4B. However, the lines of depressed portions are not necessarily set uniformly. It may be possible to employ a configuration in which, of the six lines of depressed portions, adjacent three lines of depressed portions are brought closer to each other depending on locations where the depression-provided steel pipe 4 is placed, and in terms of the symmetric position with respect to the axis of this steel pipe, the remaining adjacent three lines of depressed portions are brought closer to each other, for example.

As illustrated in FIG. 4A, the depressed portions 41 (41A to 41F) are formed into an oval shape having the major axis extending in parallel to the axial direction of the steel pipe, whereby it is possible to obtain an effect of increasing the adhesive force while reducing the circumferential length at the depressed portion 41 (41A to 41F) of the steel pipe. By setting the direction of the major axis of the oval shape so as to match the axial direction of the steel pipe, the total circumferential length of the depressed portion 41 (41A to 41F) of the steel pipe can be minimized, which makes it possible to suppress the reduction in the compressive strength caused by the formation of the depressed portions 41 (41A to 41F) as much as possible. Thus, it is desirable to form the depressed portion 41 (41A to 41F) into the oval shape having the major axis extending in parallel to the axial direction of the steel pipe. The shape of the depressed portion 41 (41A to 41F) may have a circular shape or substantially rectangular shape.

Further, the circumferential length at the depressed portions 41 (41A to 41F) of the steel pipe may be set such that, at any positions in the axial direction of the steel pipe, the percentage of the total $L_{Total}$ of the circumferential lengths $L_1$ to $L_6$ at the depressed portions 41 (41A to 41F) relative to the entire perimeter R of the depression-provided steel pipe 4 is 50% or less, preferably 40% or less, more preferably 30% or less. In other words, the upper limit value of the $L_{Total}/R$ is set to 0.50 or less, preferably 40%, more preferably 30%. The reason that "0.50 or less" is preferable has already been explained in the first embodiment.

In the depression-provided steel pipe 4 according to this embodiment, the total $L_{Total}$ of the circumferential lengths $L_1$ to $L_6$ at the depressed portion 41 (41A to 41F) is maximum at the line D-D in FIG. 4A, more specifically, at the center of each of the depressed portions 41 (21A to 21F) in the axial direction of the steel pipe. Thus, in the case of the depression-provided steel pipe 4 according to this embodiment, as illustrated in FIG. 4B, it is only necessary to set the total $L_{Total}$ of the circumferential lengths $L_1$ to $L_6$ at the depressed portions 41 (41A to 41F) of the steel pipe to 50% or less of the entire perimeter R of the depression-provided steel pipe 4.

If the total $L_{Total}$ of the circumferential lengths $L_1$ to $L_6$ of the steel pipe is 50% or less of the entire perimeter R of the depression-provided steel pipe, it is possible to suppress the reduction in the strength of the steel pipe caused by the formation of the depressed portions. Thus, it is only necessary that the percentage of the total $L_{Total}$ of the circumferential lengths $L_1$ to $L_6$ at the depressed portions of the steel pipe relative to the entire perimeter R of the depression-provided steel pipe be set to 50% or less at any positions in the axial direction of the steel pipe.

It should be noted that it is only necessary that the lower limit value at the position in the axial direction of the steel pipe where "the percentage of the total $L_{Total}$ of the circumferential lengths $L_1$ to $L_6$ at the depressed portions relative to the entire perimeter R of the depression-provided steel pipe" is the maximum be set to more than 0%. However, the lower limit value may be set to 10% or more, or 20% or more depending on required adhesive forces.

Further, in the depression-provided steel pipe 4 according to this embodiment, it may be possible to set each of the lines of the depressed portions such that the percentage of the total M2 of the longitudinal lengths at the depressed portions 41 of the steel pipe relative to the entire length M1 of the depression-provided steel pipe 4 in the axial direction of the steel pipe is set to 50% or less. This is because, in the case where the total M2 of the longitudinal lengths at the depressed portions 41 of the steel pipe exceeds 50% of the entire length M1 of the depression-provided steel pipe 4 in the axial direction of the steel pipe, the compressive strength of the depression-provided steel pipe 4 tends to decrease.

Further, at the center of each of the depressed portions 41 (41A to 41F), a columnar groove portion 42 (42A to 42F) is formed so as to be depressed deeper than the bottom surface of the depressed portion 41 and extend along the axial direction of the steel pipe. The solidified material further enters the inside of the columnar groove portion 42 (42A to 42F). Then, there occurs a frictional force or shearing force at the interface between the solidified material entering the columnar groove portion 42 (42A to 42F) and the solidified material existing in the vicinity, and this columnar groove portion 42 functions as an anti-slipper, thereby further improving the adhesive force in addition to the adhesive force resulting from the depressed portion 41. In other words, due to restriction on relative movement of the solidified material and the steel pipe in the axial direction (catching effect), it is possible to increase the adhesive force.

The depth H of the columnar groove portion 42 (42A to 42F) is set in the range of not less than 0.005D and not more than 0.2D, where D is an outside diameter of the depression-provided steel pipe 4. By setting the depth H to 0.005D or more, it is possible to obtain a frictional force between the outer peripheral surface of the steel pipe and the ground or the solidified material. On the other hand, in the case where the depth H exceeds 0.2D, the effect of improving the frictional force saturates.

As in the description in the first embodiment, in the depression-provided steel pipe 4 according to this embodiment, the average Vickers hardness $H_A$ at the depressed portion 41 and the Vickers hardness $H_B$ at the midpoint between the depressed portions 41 and 41 adjacent to each other in the axial direction of the steel pipe satisfy $0.95 \leq H_A/H_B \leq 1.05$. With such a setting, the entire steel pipe does not have any point in which the hardness suddenly changes, and hence, it is possible to avoid reducing the compressive strength.

Further, a mill scale is provided on the surface of the depression-provided steel pipe 4 according to this embodiment. Also, by forming the mill scale on the depressed portions and the columnar groove portions, it is possible to further improve the adhesive force of the depression-provided steel pipe to the solidified material. It is only necessary to apply the mill scale to 95% or more of the outer peripheral surface of the depression-provided steel pipe 1 in terms of area.

Further, on the mill scale, it may be possible to form at least one of a plating layer and a resin layer.

The depression-provided steel pipe 4 according to this embodiment is manufactured, for example, by (1) with a roll unit for forming and forge welding, rounding and forming a heated steel plate into a pipe-like shape, and jointing end portions of the steel plate, thereby forming a steel pipe, and (2) then, pressing six rolls for forming a steel pipe having a raised portion corresponding to the depressed portion 41 and the columnar groove portion 42 provided on the surface of the roll against the outer surface of the steel pipe, thereby adding the depressed portion 41 and columnar groove portion 42 uniformly in the axial direction.

With these processes, it is possible to form the depressed portions 41 (41A to 41F) and the columnar groove portions 42 (42A to 42F) at uniform intervals in the axial direction of the steel pipe, obtain uniform distribution of hardness, and apply the mill scale.

[Fifth Embodiment]

Below, with reference to FIG. 5A and FIG. 5B, a depression-provided steel pipe 5 according to a fifth embodiment of the present invention will be described. The depression-provided steel pipe 5 according to this embodiment is different from the depression-provided steel pipe 4 according to the fourth embodiment in that lines of depressed portions adjacent in the circumferential direction of the steel pipe are provided so as to have a phase difference in the axial direction of the steel pipe in this embodiment. Elements that have been already described will not be repeated.

Figure 5A:
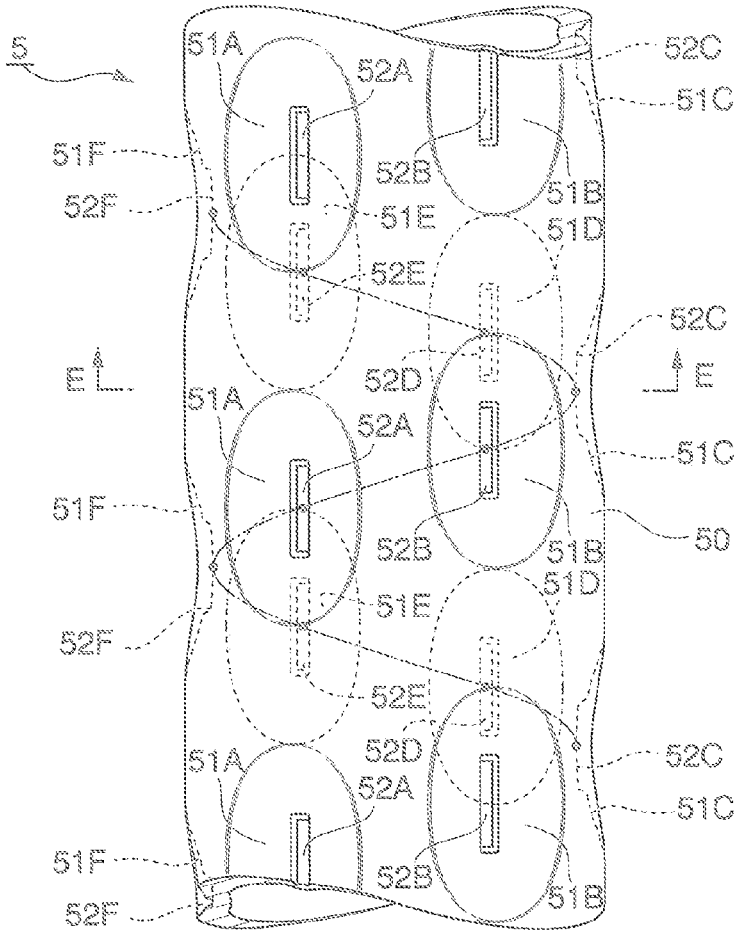
FIG. 5A is a front view partially illustrating a depression-provided steel pipe 5 according to a fifth embodiment of the present invention.

FIG. 5A is a front view partially illustrating the depression-provided steel pipe 5 according to the fifth embodiment of the present invention. The depression-provided steel pipe 5 extends in the axial direction of the steel pipe so as to have a predetermined length, and for the purpose of explanation, part of the depression-provided steel pipe 5 is illustrated in FIG. 5A.

As illustrated in FIG. 5A, the depression-provided steel pipe 5 according to the fifth embodiment of the present invention is formed by a steel pipe body 50 having a substantially tubular shape and including plural depressed portions 51 (51A to 51F) and a columnar groove portion 52 (52A to 52D) formed at the center of each of the depressed portions 51.

As illustrated in FIG. 5A, the plural depressed portions 51 (51A to 51F) are formed at predetermined intervals along the axial direction of the steel pipe, thereby forming six lines of depressed portions. Further, unlike the depression-provided steel pipe 4 according to the fourth embodiment, the depression-provided steel pipe 5 according to the fifth embodiment has the depressed portions 51 (51A to 51F) formed such that lines of the depressed portions adjacent in the circumferential direction of the steel pipe are arranged with a ⅙ phase difference. Thus, the depression-provided steel pipe 5 has a cross-section located at a longitudinal position of the steel pipe where the total circumferential length at the depressed portion 51 (51A to 51F) of the steel pipe is longest (in other words, FIG. 5B), and a cross-section located at a longitudinal position of the steel pipe where the total circumferential length at the depressed portion 51 (51A to 51F) of the steel pipe is shortest. Note that FIG. 5B is a sectional view taken along the line E-E in FIG. 5A.

Figure 5B:
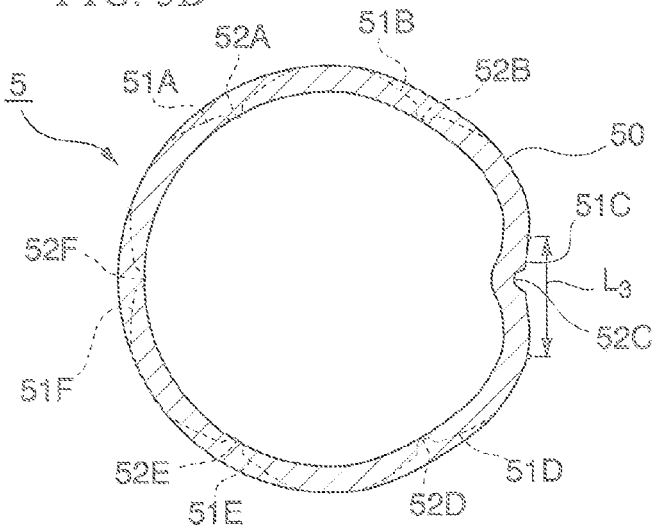
FIG. 5B is a sectional view taken along the line E-E in FIG. 5A.

As described above, in the case where the phase difference is provided, the $L_{Total}$ at the position where the $L_{Total}$ is maximum in the axial direction of the steel pipe can be suppressed as illustrated in FIG. 5B. Thus, it is possible to increase the depth of or the circumferential length at the depressed portions 51 (51A to 51F) of the steel pipe while suppressing the value of $L_{Total}/R$ to 50% or less. Thus, it is possible to achieve further excellent compressive strength while achieving the adhesive force with the same level as that of the depression-provided steel pipe 4 according to the fourth embodiment described above.

In the depression-provided steel pipe 5 according to this embodiment, although the lines of the depressed portions adjacent to each other are arranged with the ⅙ phase difference, it may be possible to set the phase difference, for example, to ½, ¼, or ⅛. However, even if the phase difference of less than ⅛ is applied, the effect obtained by the application of the phase difference is small. Thus, in the case where the phase difference is applied, it is preferable to apply the phase difference in the range of ⅛ to ½. Further, it may be possible to employ a configuration in which, rather than applying the phase difference to all the six lines of the depressed portions, the phase difference is applied to only one line of the depressed portions with respect to the other five lines of the depressed portions.

[Sixth Embodiment]

With the depression-provided steel pipes 1 to 5 according to the first to fifth embodiments, it is possible to form a composite pile used mainly for making a civil engineering and construction structure, by integrally embedding the depression-provided steel pipes into the solidified material such as concrete, cement, and soil cement. Below, as an example, a composite pile 100 using the depression-provided steel pipe according to the first embodiment will be described.

Figure 6A:
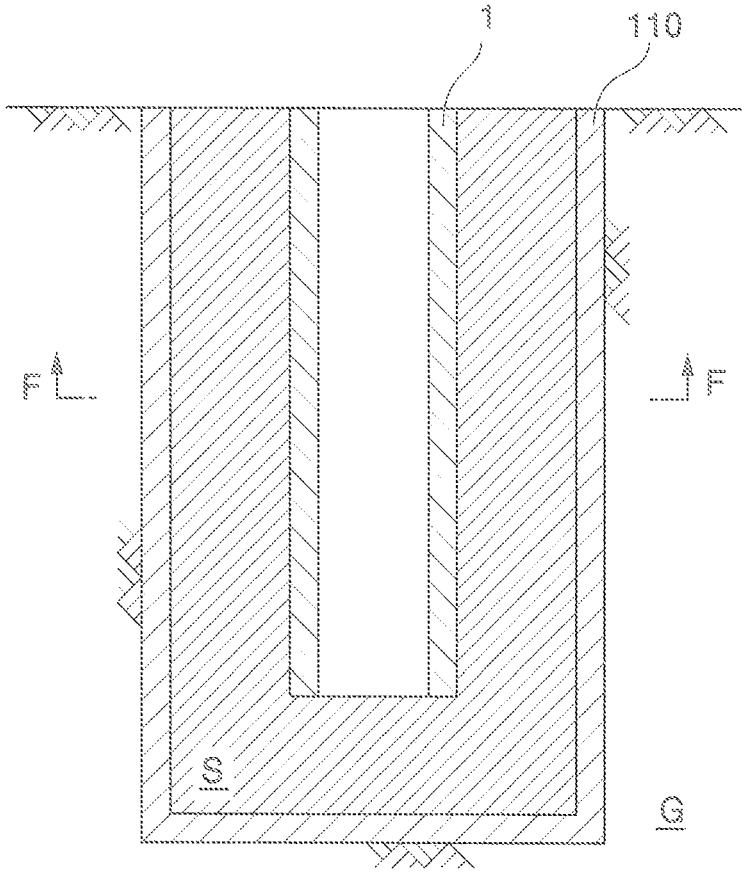
FIG. 6A is a sectional view illustrating a composite pile according to a sixth embodiment of the present invention.
Figure 6B:
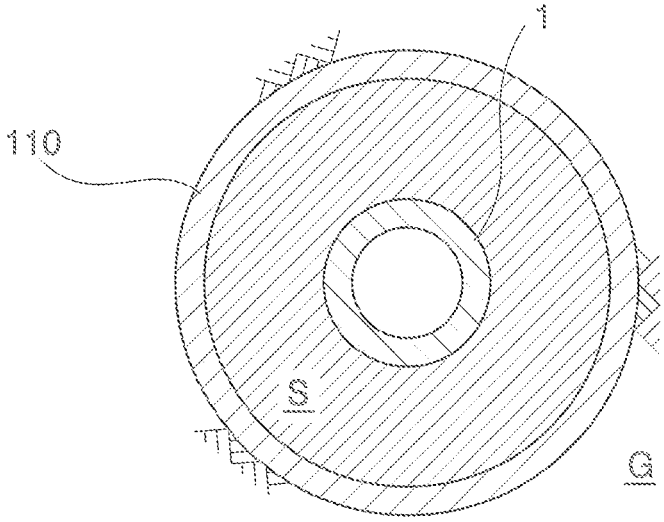
FIG. 6B is a sectional view taken along the line F-F in FIG. 6A.

FIG. 6A and FIG. 6B illustrate the composite pile 100 obtained by integrally embedding the depression-provided steel pipe 1 according to the first embodiment into soil cement S as the solidified material. FIG. 6A is a schematic sectional view illustrating a side face of the composite pile 100, and FIG. 6B is a plan sectional view schematically illustrating the composite pile 100.

As illustrated in FIG. 6A and FIG. 6B, the composite pile 100 is configured by installing the depression-provided steel pipe 1 into the soil cement S in a form 110 provided in the ground G, and solidifying the soil cement S.

It should be noted that, in order to obtain sufficient strength, the composite pile 100 needs to have sufficient adhesive strength between the depression-provided steel pipe 1 and the soil cement S.

In the case where the same soil cement S is used, the adhesive strength of the composite pile 100 depends on the shape of the steel pipe installed. With the depression-provided steel pipe 1 according to this embodiment, it is possible to obtain sufficient adhesive strength.

With the depression-provided steel pipe 1 described with reference to the drawings above, it is possible to increase the adhesive force between the steel pipe and the solidified material while suppressing the reduction in the strength of the steel pipe itself.

Further, with this depression-provided steel pipe 1, it is possible to achieve the composite pile 100 having sufficient adhesive strength while suppressing the reduction in the strength of the steel pipe itself.

In other words, with the depression-provided steel pipe 1 having sufficient strength, it is possible to form the composite pile having the adhesive strength (adhesive force) while minimizing the reduction in the strength thereof, whereby it is possible to form the civil engineering and construction structure in an economical manner.

The above describes examples of the embodiment according to the present invention. However, the present invention is not limited thereto. For example, although, in the description above, the number of lines of the depressed portions is set to 1, 4, and 6, the number may be set to 2, 3, 5, 7 or more.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

EXAMPLES

Example 1

Steel pipes 1 to 14 having a diameter (outside diameter) of 76.3 mm and a length in the axial direction of the steel pipe of 300 mm were manufactured from a steel plate having a thickness of 4.5 mm.

More specifically, the steel pipe 1 according to an example of the present invention was manufactured by: with a roll unit for forming and forge welding, rounding a heated steel plate to form it into a pipe-like shape; jointing end portions of the steel plate, thereby forming a steel pipe; then, under a condition of a temperature of approximately 800° C., pressing a steel pipe processing roll having a surface provided with a raised portion with a shape corresponding to the depressed portion and the columnar groove portion against the outer surface of the steel pipe formed above, thereby adding the depressed portion and the columnar groove portion uniformly in the axial direction.

The steel pipe 2 serving as Comparative Example was manufactured by: with a roll unit for forming and forge welding, rounding a heated steel plate to form it into a pipe-like shape; jointing end portions of the steel plate, thereby forming a steel pipe; cooling the steel pipe; and forming a depressed portion through cold working.

The steel pipe 3 serving as Comparative Example was manufactured by: with a roll unit for forming and forge welding, rounding a heated steel plate to form it into a pipe-like shape; jointing end portions of the steel plate, thereby forming a steel pipe.

The steel pipe 4 serving as Comparative Example was manufactured by: with a roll unit for forming and forge welding, rounding a heated steel plate to form it into a pipe-like shape; jointing end portions of the steel plate, thereby forming a steel pipe; then, under a condition of temperatures of approximately 800° C., pressing a roll having a surface provided with a protrusion having a shape corresponding to the depressed portion against the outer surface of the steel pipe formed above, thereby adding only the depressed portions uniformly in the axial direction.

The steel pipes 4 to 12 are examples of the present invention manufactured by changing the manufacturing conditions applied to the steel pipe 1.

Table 1 and Table 2 show specific manufacturing conditions for the steel pipes 1 to 14.

TABLE 1

| | Lines of depressed portion — | Distance between centers of depressed portion adjacent in axial direction of steel pipe mm | Shape of depressed portion — | Extending direction of depressed portion — | Circumferential length at depressed portion of steel pipe mm | Length at depressed portion in the axial direction of steel pipe mm | Phase difference — | Method of forming depressed portion — |
|---|---|---|---|---|---|---|---|---|
| Steel pipe 1 | 8 | 45 | Oval | Axial direction of steel pipe | 23 | 30 | No exist | Hot |
| Steel pipe 2 | 8 | 45 | Oval | Axial direction of steel pipe | 23 | 30 | No exist | Cold |
| Steel pipe 3 | 0 | — | — | — | — | — | — | — |
| Steel pipe 4 | 8 | 45 | Oval | Axial direction of steel pipe | 23 | 30 | — | Hot |
| Steel pipe 5 | 1 | 45 | Oval | Axial direction of steel pipe | 23 | 30 | No exist | Hot |

TABLE 1-continued

| | Lines of depressed portion — | Distance between centers of depressed portion adjacent in axial direction of steel pipe mm | Shape of depressed portion — | Extending direction of depressed portion — | Circum-ferential length at depressed portion of steel pipe mm | Length at depressed portion in the axial direction of steel pipe mm | Phase difference — | Method of forming depressed portion — |
|---|---|---|---|---|---|---|---|---|
| Steel pipe 6 | 4 | 45 | Oval | Axial direction of steel pipe | 23 | 30 | No exist | Hot |
| Steel pipe 7 | 6 | 45 | Oval | Axial direction of steel pipe | 23 | 30 | No exist | Hot |
| Steel pipe 8 | 8 | 45 | Oval | Axial direction of steel pipe | 23 | 30 | ½ | Hot |
| Steel pipe 9 | 8 | 45 | Oval | Axial direction of steel pipe | 23 | 30 | ¼ | Hot |
| Steel pipe 10 | 8 | 45 | Oval | Axial direction of steel pipe | 23 | 30 | ⅛ | Hot |
| Steel pipe 11 | 8 | 45 | Oval | Axial direction of steel pipe | 23 | 30 | 1/16 | Hot |
| Steel pipe 12 | 8 | 45 | Oval | 45° tilted to Axial direction of steel pipe | 23 | 30 | No exist | Hot |

TABLE 2

| | Formation of columnar groove portion — | Depth H of columnar groove portion mm | Circumferential length at columnar groove portion of steel pipe mm | Longitudinal length at columnar groove portion of steel pipe mm | Entire perimeter R of steel pipe mm | Total circumferential length $L_{Total}$ at depressed portion mm | $L_{Total}/R$ — |
|---|---|---|---|---|---|---|---|
| Steel pipe 1 | Formed | 2 | 3 | 20 | 239 | 184 | 76.99 |
| Steel pipe 2 | Formed | 2 | 3 | 20 | 239 | 184 | 76.99 |
| Steel pipe 3 | Not formed | — | — | — | 239 | — | — |
| Steel pipe 4 | Not formed | — | — | — | 239 | 184 | 76.99 |
| Steel pipe 5 | Formed | 2 | 3 | 20 | 239 | 23 | 9.62 |
| Steel pipe 6 | Formed | 2 | 3 | 20 | 239 | 92 | 38.49 |
| Steel pipe 7 | Formed | 2 | 3 | 20 | 239 | 138 | 57.74 |
| Steel pipe 8 | Formed | 2 | 3 | 20 | 239 | 120 | 50.21 |
| Steel pipe 9 | Formed | 2 | 3 | 20 | 239 | 110 | 46.03 |
| Steel pipe 10 | Formed | 2 | 3 | 20 | 239 | 106 | 44.35 |
| Steel pipe 11 | Formed | 2 | 3 | 20 | 239 | 170 | 71.13 |
| Steel pipe 12 | Formed | 2 | 3 | 20 | 239 | 261 | 109.21 |

For the steel pipes 1 to 14, measurement was made on "average hardness $H_A$ of the depressed portion," "hardness $H_B$ at the midpoint between depressed portions adjacent in the axial direction of the steel pipe," "$H_A/H_B$," "presence or absence of mill scale," "compressive strength," and "adhesive force." Table 3 shows the results of the measurement.

TABLE 3

| | Average hardness $H_A$ of depressed portion HV | Hardness $H_B$ at midpoint between depressed portions adjacent in axial direction of steel pipe HV | $H_A/H_B$ — | Presence or absence of mill scale — | Compressive strength kN | Adhesive force kN/m |
|---|---|---|---|---|---|---|
| Steel pipe 1 | 202 | 196 | 1.03 | Exist | 204.3 | 4.1 |
| Steel pipe 2 | 227 | 196 | 1.16 | No exist | 132.8 | 4.1 |
| Steel pipe 3 | — | — | — | Exist | 232.0 | 0.4 |
| Steel pipe 4 | 201 | 196 | 1.03 | Exist | 204.3 | 2.5 |
| Steel pipe 5 | 202 | 194 | 1.04 | Exist | 232.8 | 0.9 |
| Steel pipe 6 | 201 | 194 | 1.04 | Exist | 228.1 | 2.3 |
| Steel pipe 7 | 199 | 199 | 1.00 | Exist | 218.9 | 3.2 |
| Steel pipe 8 | 205 | 199 | 1.03 | Exist | 223.2 | 4.1 |
| Steel pipe 9 | 202 | 205 | 0.99 | Exist | 225.0 | 4.1 |
| Steel pipe 10 | 201 | 199 | 1.01 | Exist | 225.9 | 4.1 |
| Steel pipe 11 | 202 | 206 | 0.98 | Exist | 209.1 | 4.1 |
| Steel pipe 12 | 203 | 196 | 1.04 | Exist | 166.9 | 4.1 |

The "average hardness $H_A$ of the depressed portion" and the "hardness $H_B$ at the midpoint between depressed portions adjacent in the axial direction of the steel pipe" were measured such that a piece including the depression is cut from the target steel pipe to create a sample, and measuring the thickness center using a hardness meter. Five points of data were measured, and were averaged as representative data. 10 or more points of judging data were taken, and the taken data were used to obtain the average hardness and variation of the hardness.

The "presence or absence of mill scale" was obtained through visual observation.

For measurement of the "compressive strength," a steel piece with a length corresponding to two times the outside diameter of the target steel pipe was cut from the target steel pipe, and end-surface preparation was applied to obtain a sample. Tests were conducted by applying static load while paying attention to applying the load equally on cross-sectional area of the steel pipe with a compressive tester. Three samples were used for each target steel pipe, and were subjected to the tests, and the compressive strength was judged on the basis of the average of the maximum values in the load history through the measurement.

For measurement of the "adhesive force," a soil cement pillar was prepared by placing the target steel pipe at the center of the soil cement pillar such that the soil cement pillar has a diameter approximately three times larger than the diameter of the steel pipe and a length 3.5 times longer than the length of the steel pipe. The top of the steel pipe protrudes from the soil cement pillar by approximately 50 mm, which makes it possible for the driving load to act only on the steel pipe. The lower part of the soil cement pillar is supported by a base mount while the lower part of the steel pipe is not supported, which allows only the steel pipe to move when a downward load in the vertical direction is applied. After the steel pipe and the soil cement pillar are prepared as described above, 28 days of maturation period required for solidifying the soil cement was set, and a load-applying test was performed by applying a static load downwardly pressing to the top of the steel pipe. Then, the measured compressive load is divided by the outer peripheral area where the steel pipe is contacted with the soil cement, thereby calculating the adhesive force. The test was performed for three samples in two-different compressive strength of soil cement, and the adhesive force was judged.

The steel pipe 1 satisfies all the requirements for the present invention, thereby achieving excellent compressive strength and adhesive force.

The steel pipe 2 has the depressed portion formed through the cold working, which generates a portion having the excessively large average hardness $H_A$ of the depressed portion. This leads to a significant reduction in the compressive strength as compared with the steel pipe 1.

The steel pipe 3 does not have the depressed portion or the columnar groove portion formed thereto, and hence, the adhesive force significantly reduces as compared with the steel pipe 1.

The steel pipe 4 only has the depressed portion formed thereto and does not have the columnar groove portion formed thereto, and hence, the adhesive force reduces as compared with the steel pipe 1.

Further, the steel pipes 5 to 12, which were manufactured with various conditions different from that for the steel pipe 1 , achieved excellent compressive strength and adhesive force.

Example 2

As Example 2 according to the present invention, measurement was performed for the depression-provided steel pipe on how compressive yield strength of the depression-provided steel pipe changes when the percentage of the total circumferential length at the depressed portions of the steel pipe relative to the entire perimeter of the steel pipe is varied.

Figure 7:
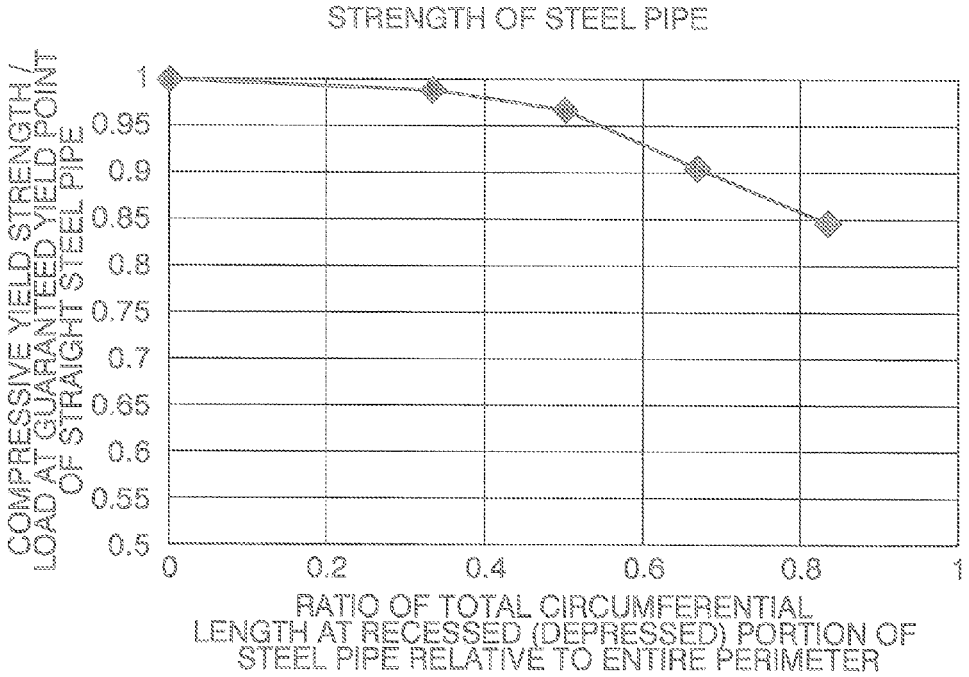
FIG. 7 is a graph illustrating a compressive strength of a depression-provided steel pipe at the time of changing the ratio of the total length of depressed portions in the circumferential direction of the steel pipe relative to the entire perimeter of the steel pipe.

FIG. 7 is a graph showing the compressive strength of the depression-provided steel pipe when the percentage of the total circumferential length at the depressed portions of the steel pipe relative to the entire perimeter of the steel pipe is varied. The vertical axis represents values of the compressive yield strength of the steel pipe, the values being made non-dimensional by load at the guaranteed yield point of the straight steel pipe (straight pipe), and the horizontal axis represents percentages of the total circumferential length at the depressed groove portions of the steel pipe relative to the entire perimeter of the steel pipe.

As can be clearly understood from FIG. 7, the compressive yield strength of the steel pipe decreases with the increase in the percentage of the total circumferential length at the depressed portions relative to the entire perimeter of the steel pipe.

In particular, it is found that, in the case where the percentage of the total circumferential length at the depressed portions of the steel pipe relative to the entire perimeter of the steel pipe exceeds 0.5, in other words, in the case where the depressed portions account for over 50% of the entire perimeter of the steel pipe, the compressive yield strength of the steel pipe significantly decreases.

As described in the embodiments above, for the general steel pipes, the allowable decrease in the strength (in particular, compressive yield strength) of the steel pipe is 5% or less.

From the graph shown in FIG. 7, it is obvious that, in the case where the percentage of the total circumferential length at the depressed portion of the steel pipe relative to the entire perimeter of the steel pipe exceeds 50%, the compressive yield strength of the steel pipe is less than 0.95. Thus, it can be understood that it is preferable to set the percentage of the total circumferential lengths at the depressed portions relative to the entire perimeter to 50% or less.

Example 3

Figure 2B:
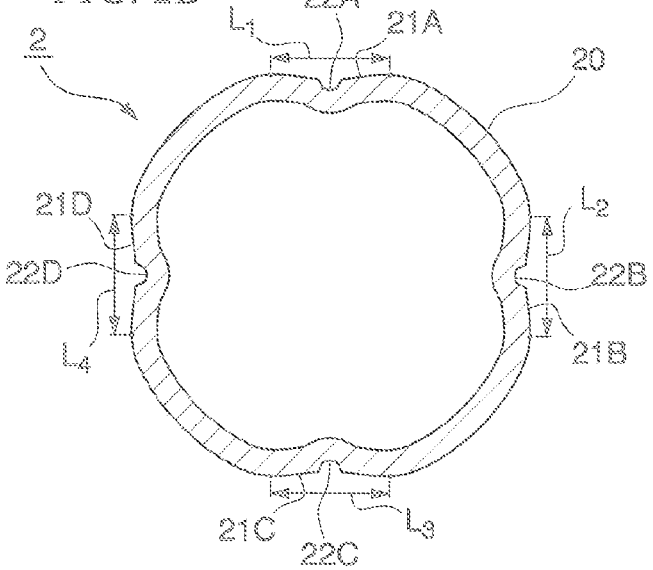
FIG. 2B is a sectional view taken along the line B-B in FIG. 2A.

Further, as Example 3, in order to confirm the advantage in the adhesive strength in the case where a composite pile is formed using the depression-provided steel pipe, composite piles with the soil cement were manufactured using three types of steel pipes:

(1) straight steel pipe;

(2) recess-provided steel pipe obtained by machining a part of the surface of the straight steel pipe through cold working, and forming a recessed portion to form the recess-provided steel pipe illustrated in FIG. 2A and FIG. 2B; and (3) depression-provided steel pipe according to the present invention illustrated in FIG. 2A and FIG. 2B.

It should be noted that the composite piles manufactured have a configuration as illustrated in FIG. 6A and FIG. 6B.

Figure 8:
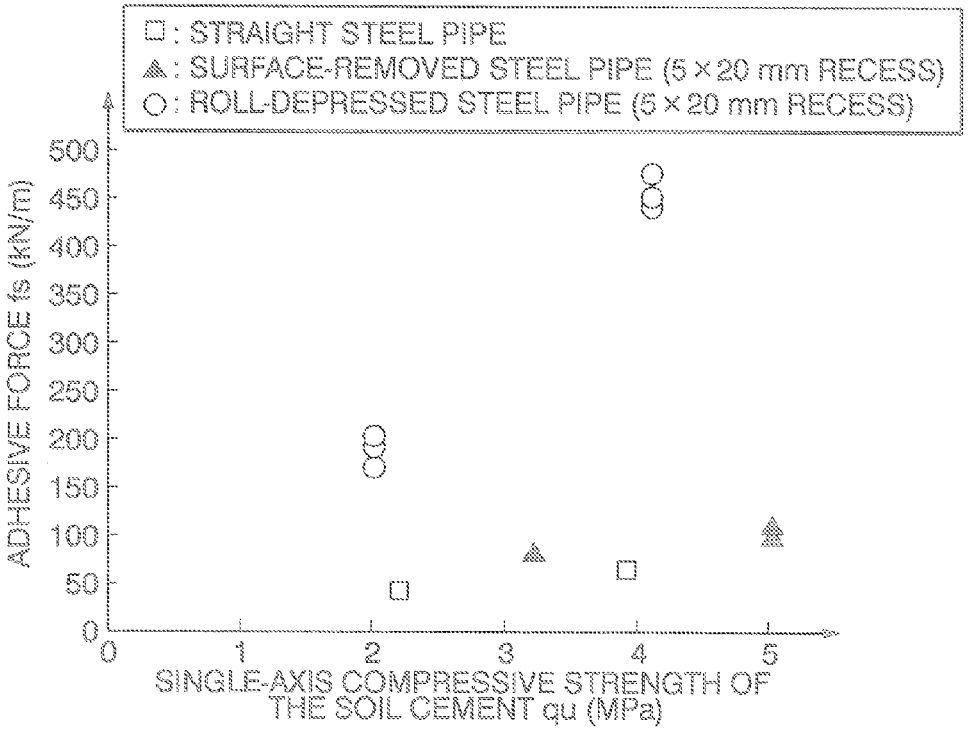
FIG. 8 is a graph showing measurement results obtained by measuring adhesive strength of three types of composite piles.

FIG. 8 is a graph showing measurement results obtained by driving the above-described three types of steel pipes (straight steel pipe, recess-provided steel pipe (surface-removed steel pipe), and depression-provided steel pipe) into the soil cement to manufacture composite piles, and measuring the adhesive strength of these composite piles.

It should be noted that, in FIG. 8, the vertical axis represents the adhesive force fs (kN/m) between the steel pipe and the soil cement, and the horizontal axis represents single-axis compressive strength qu (MPa) of the soil cement.

As illustrated in FIG. 8, it was confirmed that, of the composite piles manufactured using the three types of the steel pipes (straight steel pipe, surface-removed steel pipe, and depression-provided steel pipe), the largest adhesive strength can be obtained from the composite pile manufactured using the depression-provided steel pipe (denoted as roll-depressed steel pipe in FIG. 8) and measured on the adhesive strength.

INDUSTRIAL APPLICABILITY

The present invention is applicable to the depression-provided steel pipe and the composite pile used for forming the civil engineering and construction structure.

REFERENCE SIGNS LIST

1, 2, 3, 4, 5 Depression-provided steel pipe
10, 20, 30, 40, 50 Steel pipe body
11, 21, 31, 41, 51 Depressed portion
12, 22, 32, 42, 52 Columnar groove portion
100 Composite pile
110 Form
R Entire perimeter of steel pipe
H Depth at the deepest portion of columnar groove portion
D Outside diameter of steel pipe
S Soil cement (solidified material)
L Circumferential length at depressed portion of steel pipe
$L_{Total}$ Total circumferential length at depressed portion of steel pipe

The invention claimed is:

1. A depression-provided steel pipe having plural depressions on an outer peripheral surface , the depressions being formed so as to form a line along an axial direction of the steel pipe, wherein each of the depressed portions has, inside thereof, a columnar groove portion extending along the axial direction of the steel pipe and depressed deeper than a bottom surface of these depressed portions; $0.95 < H_A/H_B < 1.05$ is satisfied, where $H_A$ is an average Vickers hardness in each of the depressed portions, and $H_B$ is a Vickers hardness at a portion between the depressed portions adjacent to each other in the axial direction of the steel pipe; and the outer peripheral surface is covered with a mill scale.

2. The depression-provided steel pipe according to claim 1, wherein at any position along an axis of the steel pipe, a percentage of a total circumferential length at each of the depressed portions of the steel pipe relative to an entire perimeter of the depression-provided steel pipe is 50% or less.

3. The depression-provided steel pipe according to claim 1, wherein the depressed portions are arranged so as to form four or more lines in parallel.

4. The depression-provided steel pipe according to claim 3, wherein among the lines of the depressed portions, lines of the depressed portions adjacent in the circumferential direction are formed so as to have a phase difference in the axial direction of the steel pipe; and the phase difference is not less than ⅛ and not more than ½ of a distance between centers of the depressed portions adjacent in the axial direction of the steel pipe.

5. The depression-provided steel pipe according to claim 1, wherein the depressed portions are arranged so as to form six or more lines in parallel.

6. The depression-provided steel pipe according to claim 5, wherein among the lines of the depressed portions, lines of the depressed portions adjacent in the circumferential direction are formed so as to have a phase difference in the axial direction of the steel pipe; and the phase difference is not less than ⅛ and not more than ½ of a distance between centers of the depressed portions adjacent in the axial direction of the steel pipe.

7. The depression-provided steel pipe according to claim 1, wherein each of the depressed portions has an oval shape with a major axis in parallel to the axial direction of the steel pipe.

8. The depression-provided steel pipe according to claim 1, wherein at least one of a plating layer and a resin layer is formed on the mill scale.

9. A composite pile, comprising: a solidified material, and the depression-provided steel pipe according to any one of claim 1-7 or 8, which is integrally driven into the solidified material.

10. A method of producing the depression-provided steel pipe according to claim 1, the method comprising hot roll forming each of the depressed portions using a steel pipe processing roll having a surface with a raised portion.

* * * * *